US010274294B2

(12) United States Patent
Baxter et al.

(10) Patent No.: US 10,274,294 B2
(45) Date of Patent: Apr. 30, 2019

(54) CARTRIDGE CASING FOR A BLANK CARTRIDGE

(71) Applicant: BAE SYSTEMS plc, London (GB)

(72) Inventors: James Edward Baxter, Crewe (GB); Nathan William Rowe, Crewe (GB); Joshua Matthew Stubbs, Crewe (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 15/555,282

(22) PCT Filed: Mar. 1, 2016

(86) PCT No.: PCT/GB2016/050532
§ 371 (c)(1),
(2) Date: Sep. 1, 2017

(87) PCT Pub. No.: WO2016/142652
PCT Pub. Date: Sep. 15, 2016

(65) Prior Publication Data

US 2018/0058829 A1 Mar. 1, 2018

(30) Foreign Application Priority Data

Mar. 9, 2015 (EP) ..... 15275060
Mar. 9, 2015 (GB) ..... 1503918.3

(51) Int. Cl.
*F42B 8/04* (2006.01)
*F42B 5/285* (2006.01)
*F42B 5/29* (2006.01)

(52) U.S. Cl.
CPC ..... *F42B 8/04* (2013.01); *F42B 5/285* (2013.01); *F42B 5/29* (2013.01)

(58) Field of Classification Search
CPC ..... F42B 8/04; F42B 5/285; F42B 5/29
USPC ..... 102/444
See application file for complete search history.

(56) References Cited

U.S. PATENT DOCUMENTS 3,672,301 A * 6/1972 Abbott ..... F42B 8/04 102/530
2014/0224144 A1* 8/2014 Neugebauer ..... F42B 5/285 102/470
2016/0245626 A1* 8/2016 Drieling ..... F42B 5/295

FOREIGN PATENT DOCUMENTS

DE 3244548 A1 6/1984
EP 0056075 A2 7/1982
FR 1081764 A 12/1954
FR 2899321 A1 10/2007
WO 2008091245 A2 7/2008
(Continued)

OTHER PUBLICATIONS

International Preliminary Report on Patentability received for Patent Application No. PCT/GB2016/050532, dated, Sep. 21, 2017. 8 pages.

(Continued)

*Primary Examiner* — Samir Abdosh
(74) *Attorney, Agent, or Firm* — Finch & Maloney PLLC

(57) ABSTRACT

A cartridge casing comprising a casing tube formed substantially of metal with a closed end and an open end. The casing tube bounds at least part of a head cap entered into the open end of the tube. The head cap is fixed relative to the tube. An end wall defines the closed end opposite the head cap end of the cartridge. The end wall comprises a weakened region.

16 Claims, 7 Drawing Sheets

(56) References Cited

FOREIGN PATENT DOCUMENTS

WO 2016142652 A1 9/2016

OTHER PUBLICATIONS

International Search Report and Written Opinion received for Patent Application No. PCT/GB2016/050532, dated, May 30, 2016. 10 pages.
GB Intellectual Property Office Search Report under Section 17(5) received for GB Patent Application No. 1503918.3 (as it relates to claim one) dated Apr. 27, 2015. 3 pages.
GB Intellectual Property Office Search Report under Section 17(5) received for GB Patent Application No. 1503918.3 (as it relates to claims 10-14) dated May 19, 2015 . 2 pages.
Extended European Search Report received for EP Patent Application No. 15275060.0 dated Sep. 1, 2015. 8 pages.

* cited by examiner

CARTRIDGE CASING FOR A BLANK CARTRIDGE

The present disclosure relates to a cartridge casing.

In particular the disclosure is concerned with a cartridge casing for a blank round.

BACKGROUND

A conventional cartridge casing 10 is shown in FIG. 1. The cartridge assembly 10 comprises a casing 12 and a projectile 14. The casing 12 has a hollow section 16 which will contain propellant (or "charge") for displacement of the projectile 14. The casing 12 further comprises an integral head 18 at the end opposite to the projectile 14 which comprises a chamber 20 for a percussion cap, and a flash tube 22 for communication of an ignition charge from the percussion cap to the inside of the casing 12 and thus the propellant. The walls of the chamber 16 are formed integrally with the head 18. Such a cartridge casing may typically be formed of brass. This material choice has many advantages, for example, it is relatively easy to form into the desired shape. However, brass has demerit in that it is also relatively dense, and hence the casing 12 forms a relatively large percentage of the mass of the whole cartridge.

Side and end views of a conventional blank ammunition round (i.e. without projectiles, for training purposes) is shown in FIG. 2. These may be manufactured using the same basic processes as used for conventional cartridge cases. They comprise an extended cartridge casing 12' such that an open end 30 of the casing wall is extended to take up the space normally occupied by the bullet 14 in a live round. The open end 30 is closed by way of a "petalled" crimp 38 which is sealed using a liquid varnish/adhesive like sealant. The blank round is closed at its other end by an integral head cap 18' formed as one piece with the walls of the casing 12'. This configuration defines a chamber 20' for a percussion cap 32, and a flash tube 22' for communication of an ignition charge from the percussion cap 32 to the hollow interior 16 inside the casing 12 to thus ignite a propellant (or "charge") 36 provided therein. On firing the pressure in the casing 12' builds up, and then opens up the front closure, the resultant energy delivered being used to operate the weapon system. This design tends to suffer from sealing problems around the crimp, leading to misfire and jamming of the weapon system.

Thus a cartridge casing for a blank ammunition round which is more reliably sealed, thus resulting in more reliable operation, is highly desirable.

SUMMARY

According to the present disclosure there is provided an apparatus and method as set forth in the appended claims. Other features of the invention will be apparent from the dependent claims, and the description which follows.

Accordingly there may be provided a cartridge casing comprising: a casing tube formed substantially of metal with a closed end and an open end; the casing tube bounding at least part of a head cap entered into the open end of the tube; the head cap being fixed relative to the tube; wherein an end wall defines the closed end opposite the head cap end of the cartridge; and the end wall comprises a weakened region.

The casing tube may be made of a continuous metal element.

The end wall may be continuous.

The end wall may be integral with and continuous with the remainder of the tube.

The end wall may be substantially flat.

The weakened region may be thinner than the remainder of the end wall.

The weakened region may be provided as a stamped pattern on the end wall.

The formation of a weakened region on the closed end of the tube allows for monitoring of the quality and reproducibility of the closed end of the tube, prior to forming the weakened region. The closed end of the tube is already air tight, and thus the quality and reproducibility of the weakened region may be more consistent as no air tight seal is formed during the final step. Further the weakened region is formed thereon, before the final blank ammunition is prepared. The formation of a weakened region on an already closed end, mitigates against defects of forming a final product in which the final steps are to produce the required closure in the form of a weakened region. In the prior art the final steps are to close an open end or partially open end, and perform a drawing or crimping step to provide the weakened region. The steps of quality control of the weakened region in the current arrangement may be carried out without any propellant or energetic material being present.

The open end of the casing tube may be deformable to sealingly join the tube to the head cap.

There may also be provided a blank round comprising a cartridge casing according to the present disclosure which contains a charge such that, when the charge is ignited the casing is blown open at the weakened region of the casing.

There may also be provided a method of manufacturing a cartridge casing comprising the steps of: providing a material sheet; and deforming the material sheet to comprise a cylindrical tube such that the cylindrical tube is open at one end and closed at its other end by an end wall.

The method may further comprise the step of providing a weakened region in the end wall.

The weakened region may be provided by stamping the end wall to thereby indent/notch the material of the end wall.

The process may further comprise the steps of: entering a pre-formed head cap into the open end of the casing tube; deforming/crimping the casing tube such that the casing tube and head cap are sealingly joined together.

The process may further comprise the steps of: entering a pre-formed head cap into the open end of the casing tube; sealingly joining the casing tube and head cap together by a laser or friction welding process.

There may also be provided a method of manufacturing a blank round comprising the steps of at least in part filling the a cartridge according to the present disclosure with a charge; such that, when the charge is ignited the casing is blown open at the weakened region of the casing.

Hence there is provided a cartridge casing, a blank ammunition round and method of manufacture which are an improvement upon the related art. Since propellant is held in a round that is inherently better sealed than blank ammunition rounds of the related art, the round is more inclined to discharge on demand, thus resulting in more reliable operation of the weapon system which it is provided for.

BRIEF DESCRIPTION OF THE DRAWINGS

Examples of the present disclosure will now be described with reference to the accompanying drawings, in which.

DETAILED DESCRIPTION

Figure 3:
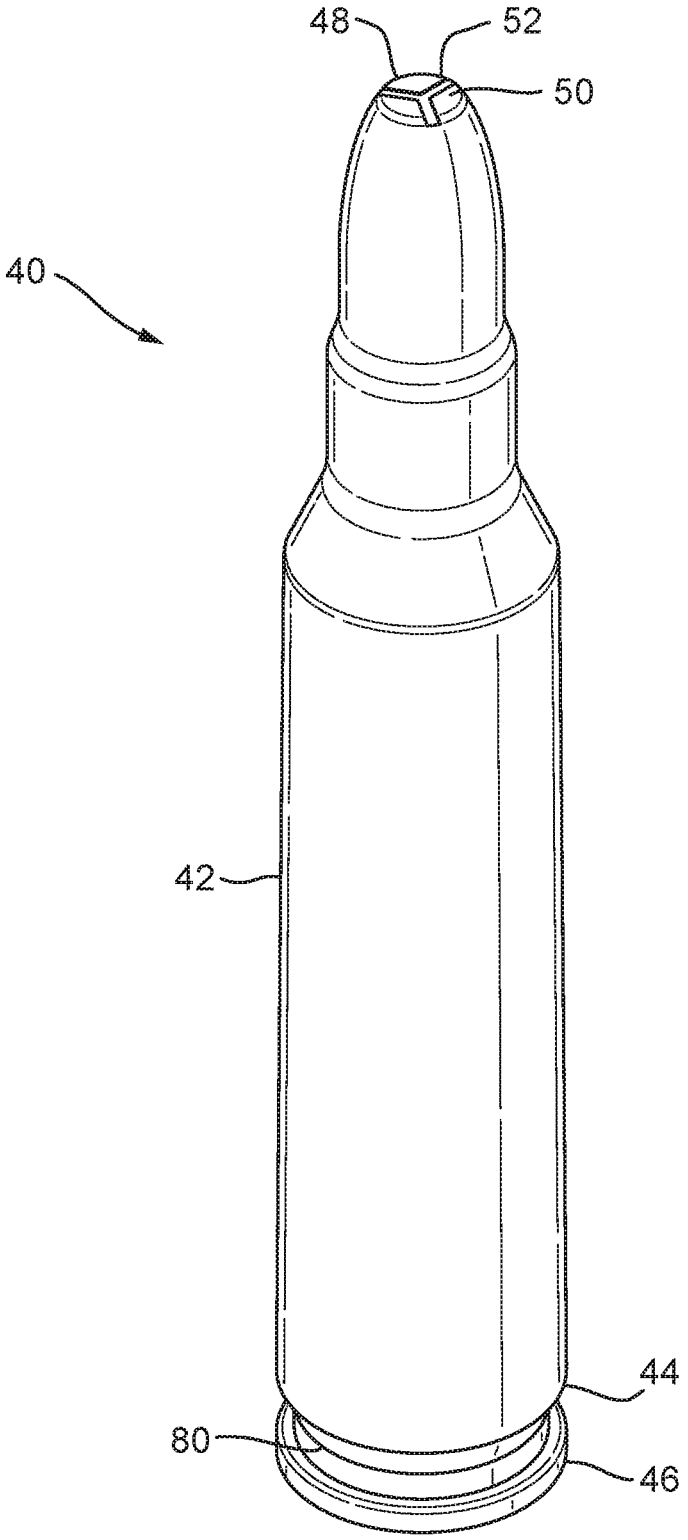
FIG. 3 shows an isometric view of a blank ammunition round according to the present disclosure.
Figure 4:
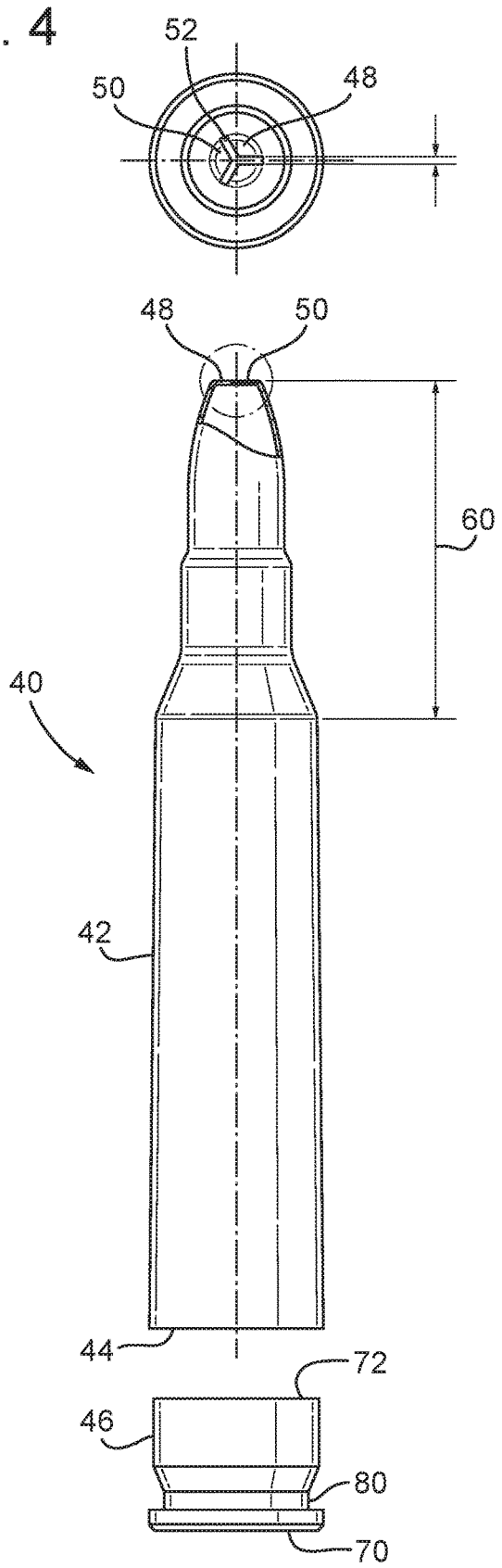
FIG. 4 shows a side and end view of the cartridge casing, and side view of the head cap, of the blank ammunition round shown in FIG. 3.
Figure 5:
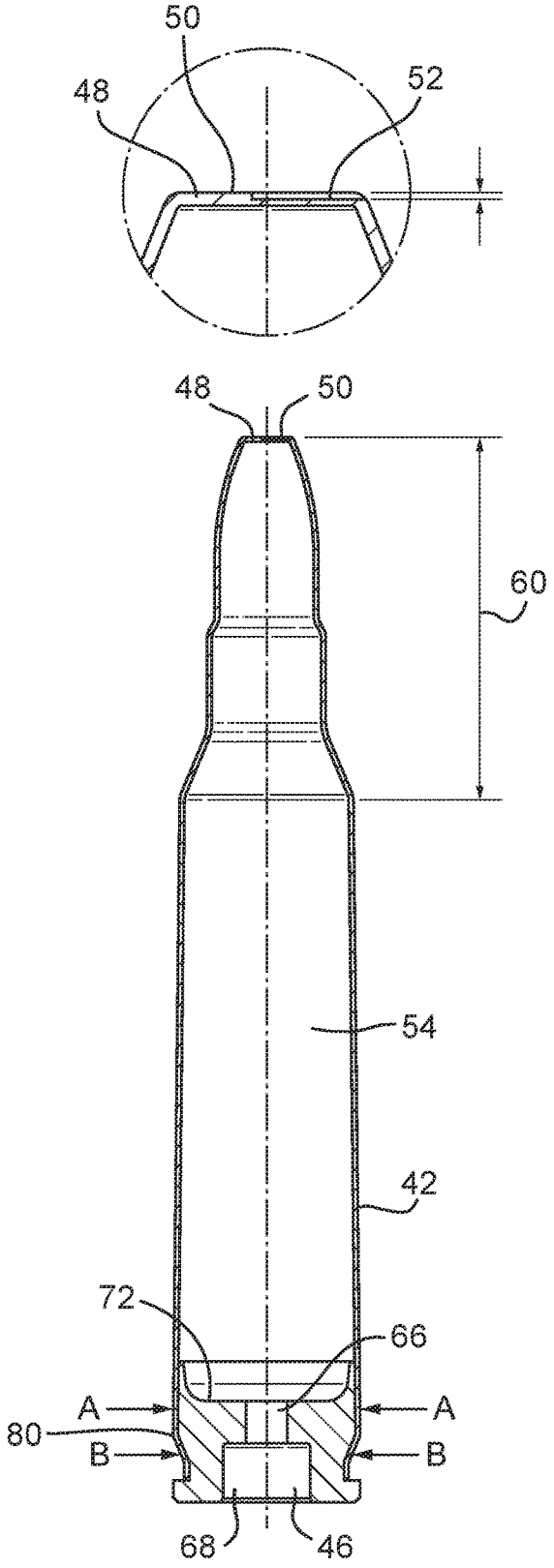
FIG. 5 shows a cross sectional view of the blank ammunition round shown in FIG. 3, as well as an enlarged view of a closed end of the casing.

FIG. 3 shows an example cartridge casing 40 according to the present disclosure. FIG. 4 shows a side and end view of a casing tube 42, and a side view of a head cap 46 according to the present disclosure. FIG. 5 shows a cross sectional view of the assembled cartridge casing 40, with the head cap 46 fixed into place in the casing tube 42.

The cartridge casing 40 comprises a casing tube 42 having an open end 44 which is closed by a head cap 46. The casing tube 42 is made of a single continuous metal element or sheet. The casing tube 42 may be formed substantially of metal, and the head cap 46 may be formed of a metal or non-metallic material. The casing tube 42 is substantially cylindrical and has an internal diameter at the open end 44 which receives the head cap 46. The casing tube 42 bounds at least part of the head cap 46 entered into its open end 44. The head cap 46 is configured to support and reinforce the base of the casing tube 42 to prevent it from swelling and rupturing during operation. As will be described in more detail later, the head cap 46 is fixed relative to the casing tube 42, thereby fixing the head cap 46 and casing tube 42 relative to one another. The open end 44 of the casing tube 42 may be deformable to sealingly join the tube to the head cap.

The casing tube 42 further comprises a closed end 48 opposite the head cap 46 end of the cartridge 40. An end wall 50 defines the closed end 48. That is to say the casing tube 42 terminates at the closed end 48, distal to the open end 44. The end wall 50 is continuous. The end wall 50 is integral with and continuous with the remainder of the tube 42. The end wall 50 may be substantially flat.

The end wall 50 comprises a weakened region 52. The weakened region 52 is thinner than the remainder of the end wall 50. The weakened region 52 may be provided as a stamped pattern on the end wall 50.

The closed end 48 has a diameter which may be substantially the same as, or less than, the diameter of the open end 44. In the example shown the diameter of the closed end 48 is substantially less than the diameter of the open end 44.

The walls of the casing 42 define a substantially cylindrical thin walled chamber 54. The tube casing 42 has a substantially constant diameter along a first region of its length between the open end 44 and the closed end 48. However, the cylindrical thin walled chamber 54 may have a taper (for example) <1° along at least part or all of its length. That is to say, although having a substantially constant diameter along its length, the diameter of the casing 42 may decrease slightly in a direction away from the open end 44, reducing in diameter from the open end 44 to the closed end 48.

The casing tube 42 also comprises a transition region 60 towards or at the closed end 48 where the transition region 60 of the casing tube 42 reduces in diameter in a direction away from the open end 44 to the closed end 48. Hence the diameter of the casing tube 42 will be different on either side of the transition region 60. The diameter of the casing tube 42 between the open end 44 and transition region 60 is substantially constant.

The transition region 60 may comprise one or more sub regions where the diameter is further reduced in a direction away from the open end 44 towards the closed end 48, for example by way of a step change, linear gradient change, bevel or radiused shoulder.

The head cap 46 defines a passage 66 which extends all of the way through the head cap 46 which in use will be a flash tube (or "flash passage"). The flash tube/passage 66 extends into a chamber 68 which, in use, will house a percussion cap (sometimes referred to as a "primer"). Thus the head cap 46 has a percussion side 70 which, in use, faces away from the casing tube 42.

The head cap 46 further comprises a charge side 72 which, in use, defines part of the internal surface of the cartridge casing 40. Thus the flash passage 66 extends between the percussion side 70 and the charge side 72.

The head cap 46 has an external diameter at least part way along its outer periphery sized such that it fits within the open end 44 of the casing tube 42. The relative dimensions of the internal diameter at the open end 44 of the casing tube 42 and the external diameter of corresponding region of the head cap 46 may be such when the head cap 46 is located in the casing tube 42 they form an interference fit with one another.

The casing tube 42 and head cap 46 may comprise a welded join which bonds them together in a region where they form an interference fit with one another. For example, the join may be provided around the circumference of the casing tube 42 and head cap 46 in a region where they interface with one another. Such a region is indicated with arrows "A" in FIG. 5. The join may be a through weld or stake weld.

The weld may achieved by laser welding. Alternative weld joins may be provided which brought only material of the casing tube 42 into a molten state, or brought material of both the casing tube 42 and head cap 46 into a molten state.

The weld join may be provided by any appropriate welding process. In the context of the present disclosure, "welding" is intended to cover joining processes that produce bonding of materials by heating, which may be done with or without pressure or filler material. For example, the term is intended to encompass brazing and soldering. It may also be taken to encompass a process in which the material of one or more articles being joined are brought into a molten state to facilitate bonding. It may include a process in which the base materials melt along with a filler material.

Alternatively the casing tube 42 may be crimped around the head cap 46 to form a join and seal, for example in a recessed region 80 of the head cap 46, as indicated with arrows "B" in FIG. 5. Thus the open end 44, being formed from a deformable material, is crimped around the head cap 46 to thus take up the shape of the recess of the head cap 46, thus trapping the head cap 46 and casing 42 together and forming a seal.

The casing tube 42 and head cap 46 may be formed from a metal, metallic material or metal alloy comprising, for example, aluminium or titanium. In one example the casing tube 42 and head cap 46 may comprise ferritic alloys, for example stainless steel. The head cap 46 may alternatively be formed from non metallic material and/or metal-plastic composite material. The casing tube 42 and head cap 46 may be made of the same or dissimilar materials. The choice of welding process (if used) will be determined in part by the choice of materials used, as appropriate and as understood in the art.

Figure 6:
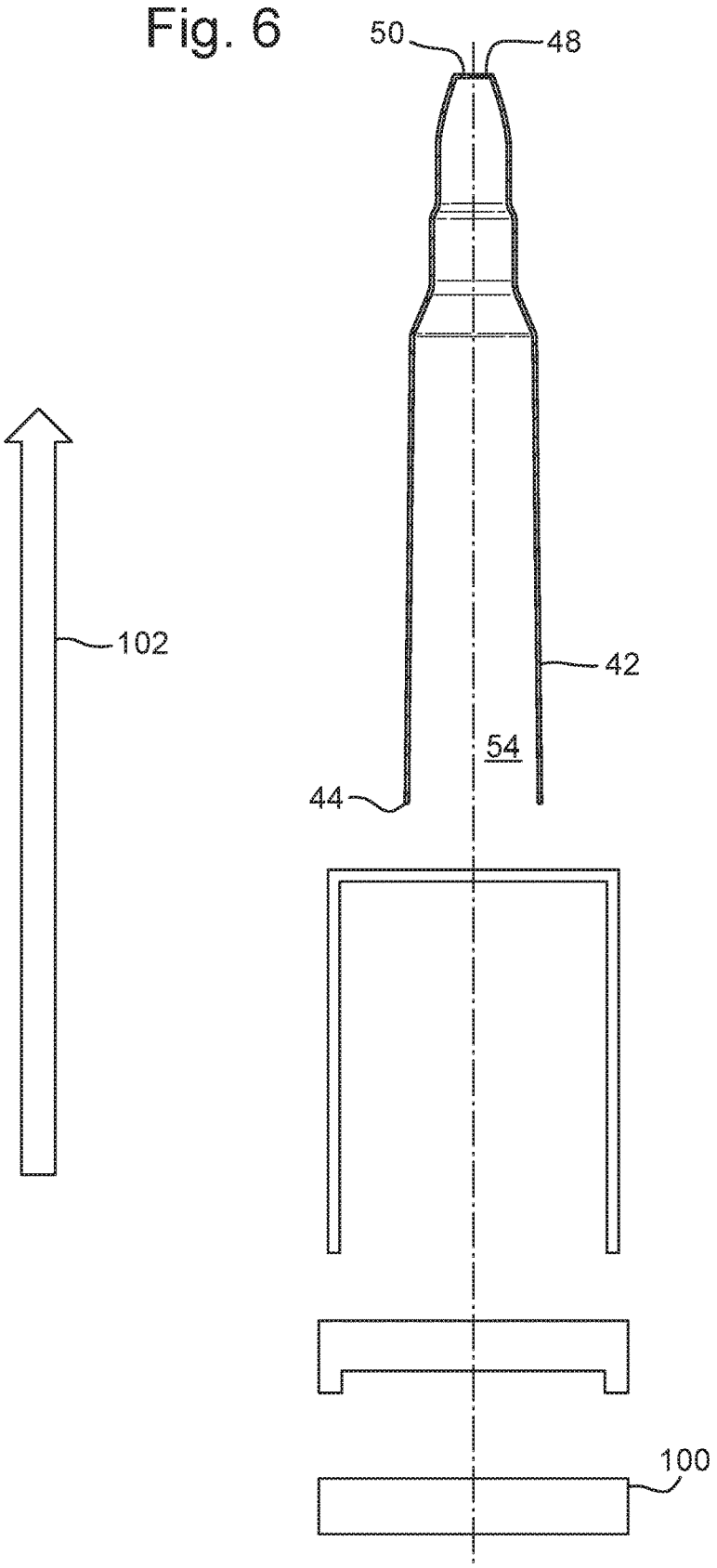
FIG. 6 shows an example forming process for a casing tube of the cartridge casing of the present disclosure.
Figure 7:
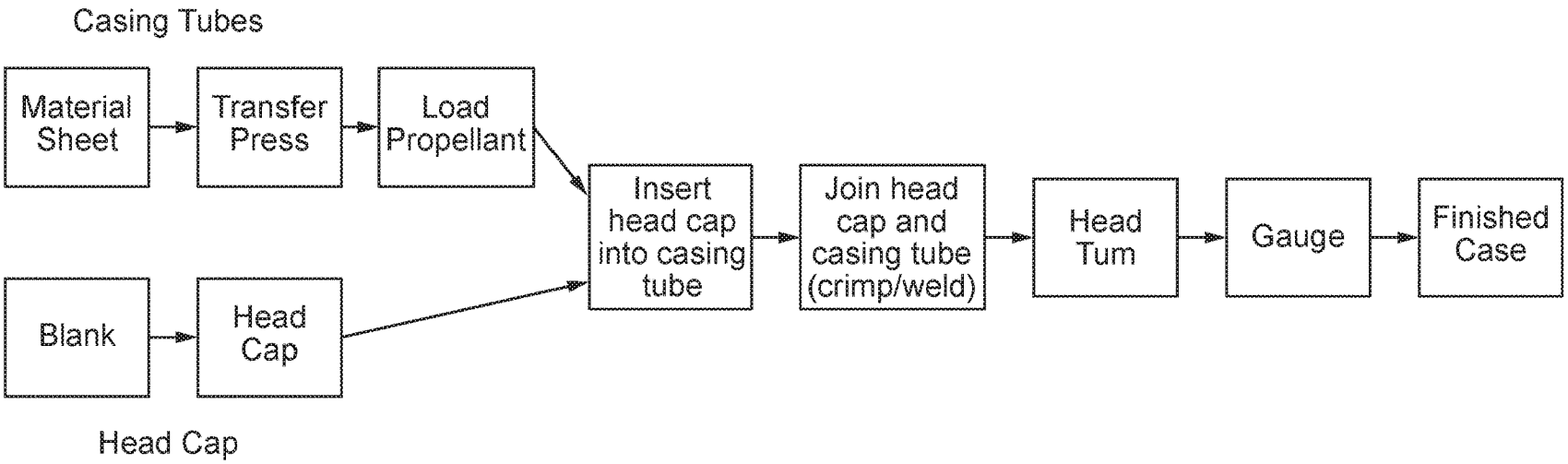
FIG. 7 summaries an example process for the manufacture of a blank ammunition round according to the present disclosure.

The method of manufacture of a cartridge casing 40 according to the present disclosure and as shown in FIGS. 3 to 5 is illustrated in FIG. 6, which shows cross sections of the different shapes which a metal sheet 100 is deformed into as it transitions between the flat sheet 100 and the finished tube 42. FIG. 7 is a flow diagram showing the manufacturing steps of the casing tube 42, head cap 46 and how they are joined and further processed.

The method comprises a first process including the steps of providing a material sheet 100, and deforming the material sheet 100 into a substantially cylindrical tube (that is to say, deforming the material sheet to comprise a cylindrical tube) by pressing and deforming the sheet in a number of steps, illustrated by way of example by arrow 102 in FIG. 6. The pressing method is such to provide a cylindrical tube which is closed at one end by an end wall 50 and open at the opposite end 44.

The material sheet 100 for example a stainless steel strip 100, is formed on a transfer press into a tapered casing tube 42 as shown in FIG. 6. In an independent process, as shown in FIG. 7, a stainless steel wire, or blank of material, is machined and/or formed into a cylindrical head cap 46, perhaps by a cold forming process.

Propellant 36 is then added to the casing tube 42. With the propellant in the casing tube 42, the casing tube 42 and head cap 46 are joined in a third independent process, after the casing tube 42 and head cap 46 are assembled.

The material sheet 100 which may be deformed in a series of steps, shown in sequence from the bottom to the top of the page on FIG. 6 in the direction shown by the arrow 102. Although details of the process may vary, the material is gradually formed through intermediate stages in which the features of the casing tube 42 are provided. The thin walls of the cylindrical tube 42 are drawn from the material strip 100, during which process the tapered transitional region 60 may be formed. The material sheet 100 is deformed such that the cylindrical tube 42 is formed open at the open end 44 and closed at the closed end 48 opposite to the open end 44.

Alternatively the casing tube 42 may be formed from a pre-drawn tube.

The transition region 60 of the cylindrical tube 42 narrows towards the closed end 48 such that the second end has a diameter less than that of the open end 44. The profile and features of the transition region 60 may be formed by swaging the cylindrical tube 42.

A weakened region 52 is provided in the end wall 48. This may be provided by stamping the end wall to thereby indent/notch the material of the end wall to provide a thinner section. The indentation does not extend through the end wall 48. That is to say, the indentation is provided in the end wall 48, but the end wall 48 still provides a fluid barrier between the internal chamber 16 of the tube 42 and the external environment in which it is located.

The second process, for forming the head cap 46, comprises the step of providing the blank of material, machining and/or forming the material blank into the cylindrical head cap 46 such that the head cap 46 has an external diameter substantially identical to the internal diameter of the open end 44 of the casing tube 42 to thereby provide an interference fit between the two. Alternatively it may be formed with an external diameter slightly less than the internal diameter of the casing tube 42 such that the interference fit is negligible or completely absent. The head cap 46 is also formed with the passage 46 which extends all the way through the head cap 46.

The head cap 46 may be turned, or cold formed, or any other appropriate method for the forming of a head cap 46.

The third process may comprise the steps of entering the head cap 46 into the open end 44 of the casing tube 42. The casing tube 42 and head cap 46 are then joined (i.e. fixed) together, thereby sealing in propellant 36 in the chamber 54.

The casing tube 42 and head cap 46 may be welded to one another in a region where they form an interference fit with one another. For example, they may be welded to one another by applying a localised welding process around the circumference of the casing tube 42, on the external surface of the casing tube 42, radially outward of where the casing tube 42 is in contact with the external diameter of the head cap 46. Such a region is indicated with arrows "A" in FIG. 5. This may be achieved by a through weld or stake weld process.

Alternatively or additionally, the casing tube 42 may be crimped around the head cap 46 to form a join and seal, for example in a recessed region 80 of the head cap 46, as indicated with arrows "B" in FIG. 5. Thus the open end 44 formed, being formed from a deformable material, is crimped around the head cap 46 to thus take up the shape of the recess of the head cap 46, thus trapping the head cap 46 and casing 42 together and forming an air tight seal.

Prior to assembly the casing tube 42 and head cap 46 may be prepared for welding (if used), for example being degreased. Post welding, no subsequent machining may be required, and neither may a cleaning of the casing be required.

Post joining of the casing tube 42 and head cap 46, the cartridge 40 may be turned to ensure the head cap 46 is properly centred on the casing tube 42, and to provide any other additional features required for successful functioning of the cartridge. The assembly is then gauged to ensure it meets the correct dimensional tolerances.

Hence there is provided a blank round, and method for producing such, comprising a cartridge casing which contains a charge such that when the charge is ignited the casing is blown open at the weakened region of the casing.

That is to say, when the charge 36 in the completed blank ammunition round is fired, the pressure build in the hollow chamber (or cavity) 16 induces a force on the end wall 48. The weakened region 52 will fail, causes the end wall 48 rupture. Thereafter, the ammunition of the present disclosure operates as conventional blank ammunition.

Thus there is provided a blank ammunition round and method of manufacture, which because it is better sealed, is more inclined to discharge on demand, thus resulting in more reliable operation of the weapon system which it is provided for.

The thin cartridge casing with a thin wall casing tube of the present disclosure may be made of a material which is inherently lighter than conventional cartridge cases. The material choice enables the casing tube to withstand the ignition pressures induced during operation whilst also being made by a reliable and repeatable manufacturing process.

Since the casing may have a thinner wall than that of the related art, and is made of a material which has a lower density than that used for conventional casings, the resultant cartridge casing will overall be lighter than an equivalent conventional casing. Hence for a given amount of powder propellant, a cartridge having a casing of the present disclosure will produce the same performance for less overall cartridge mass than a conventional cartridge assembly.

The choice of material for the cartridge can be made to optimised to match the design pressure requirements for the ammunition, thus minimising material content. Employing a metal as the casing tube material will ensure than the integrity of the round will not be affected when used in a hot weapon.

Figure 1:
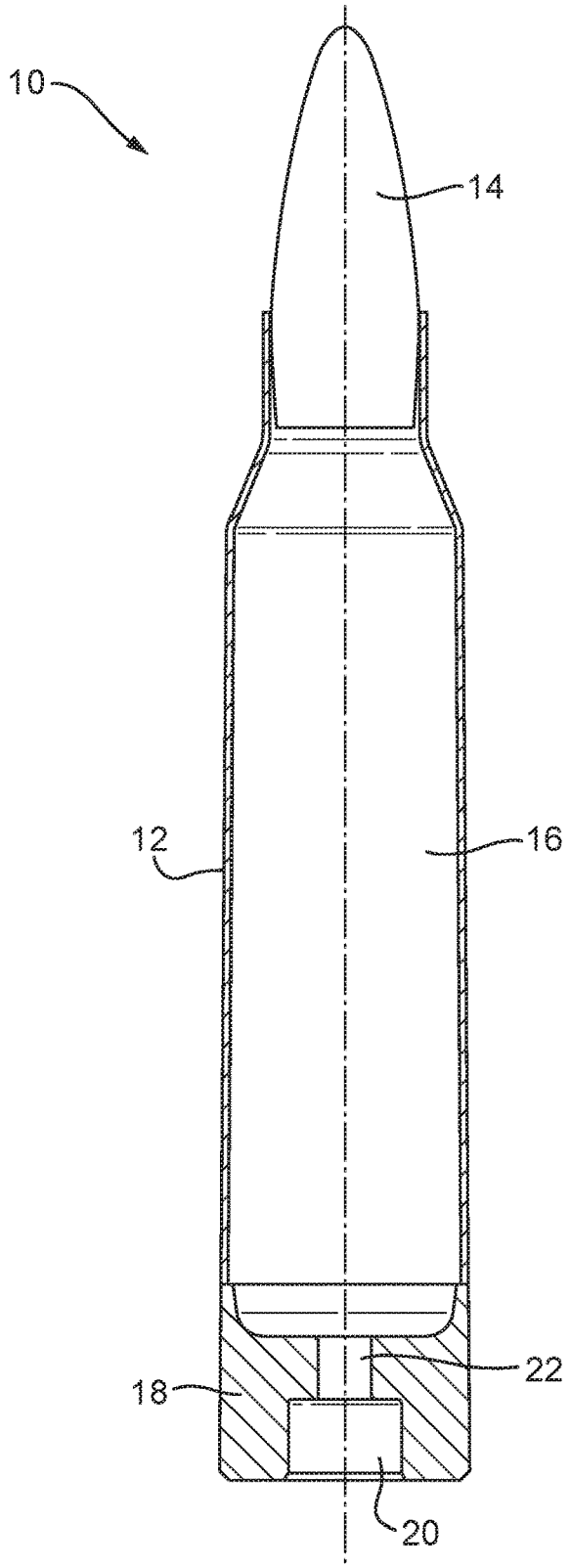
FIG. 1 shows a conventional cartridge casing for a live round, as described previously.
Figure 2:
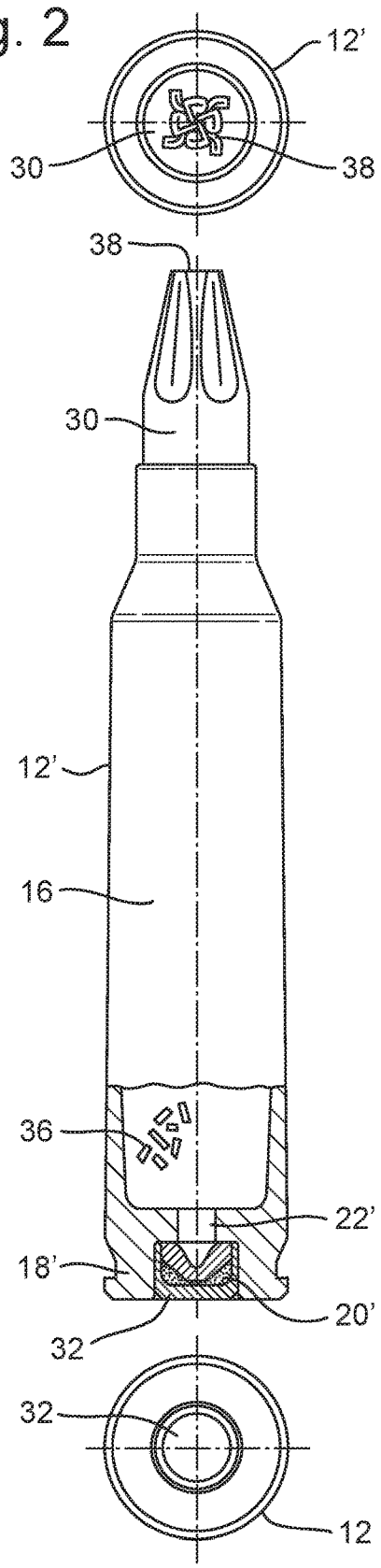
FIG. 2 shows side and end views of a conventional cartridge casing for a blank ammunition round, as described previously.

The cartridge casing may be made from a steel alloy or titanium alloy, which provide for a lighter casing and round than achievable using material of conventional blank rounds, namely brass. Since steel alloys and titanium alloys are less ductile than brass, they cannot be crimped in the way shown in related art FIG. 2 to produce a petalled seal, but can be crimped or welded to produce a seal with a head cap, as described above in relation to the present invention. That is to say, the joint between the head cap 46 and casing 42 is inherently easier to seal than the "petal" crimp on the conventional blank ammunition.

Additionally the end wall 48, being integral with and continuous with the rest of the casing tube, is inherently air tight, thereby preserving the life of the round.

Hence the configuration of the present disclosure enables a method for consistently producing a well sealed blank round of relatively low weight.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A blank round comprising:

a cartridge casing including a casing tube formed substantially of a ferritic alloy, the casing tube configured with a closed end and an open end, and a head cap entered into the open end of the casing tube, the casing tube bounding at least part of the head cap, the head cap being fixed relative to the casing tube, wherein an end wall defines the closed end opposite the head cap end of the cartridge, the end wall including a weakened region, wherein at least a portion of the closed end of the casing tube tapers to the end wall, the tapered portion being at a position where a bullet would be located if the blank round was a live round; and a charge contained in the cartridge casing such that, when the charge is ignited, the cartridge casing is blown open at the weakened region of the end wall.

2. The blank round of claim 1, wherein the casing tube is made of a continuous material sheet.

3. The blank round of claim 1, wherein the end wall is continuous.

4. The blank round of claim 1, wherein the end wall is integral with and continuous with a remainder of the casing tube.

5. The blank round of claim 1, wherein the end wall is substantially flat.

6. The blank round of claim 1, wherein the weakened region is thinner than a remainder of the end wall.

7. The blank round of claim 1, wherein the weakened region is provided as a stamped pattern on the end wall.

8. The blank round of claim 1, wherein the open end of the casing tube is deformable to sealingly join the casing tube to the head cap.

9. A method of manufacturing a blank round, the method comprising:

providing a material sheet of a ferritic alloy;

deforming the material sheet to comprise a casing tube such that the casing tube is open at one end and closed at its other end by an end wall, wherein at least a portion of the closed end of the casing tube tapers to the end wall, the tapered portion being at a position where a bullet would be located if the blank round was a live round;

providing a weakened region in the end wall;

at least in part, filling the casing tube with a charge such that, when the charge is ignited, the casing tube is blown open at the weakened region of the end wall;

entering a head cap into the open end of the casing tube; and joining the head cap and the casing tube.

10. The method of claim 9, wherein the weakened region is provided by stamping the end wall to thereby indent/notch the material of the end wall.

11. The method of claim 9, wherein the method further comprises deforming the casing tube such that the casing tube and the head cap are sealingly joined together.

12. The method of claim 9, wherein the method further comprises sealingly joining the casing tube and the head cap together by a laser or friction welding process.

13. A blank round comprising:

a casing tube formed substantially of a ferritic alloy, the casing tube configured with a closed end and an open end, wherein an end wall defines the closed end opposite the open end of the casing tube, the end wall including a weakened region that is thinner than a remainder of the end wall, wherein the end wall is integral with and continuous with a remainder of the casing tube, and wherein the casing tube is configured to blow open at the weakened region in response to a charge igniting in the casing tube, and wherein at least a portion of the closed end of the casing tube tapers to the end wall, the tapered portion being at a position where a bullet would be located if the blank round was a live round; and a head cap entered into the open end of the casing tube, the casing tube bounding at least part of the head cap, the head cap being fixed relative to the casing tube.

14. The blank round of claim 13, wherein the end wall is substantially flat.

15. The blank round of claim 13, wherein the weakened region is provided as a stamped pattern on the end wall.

16. The blank round of claim 13, wherein the open end of the casing tube is deformable to sealingly join the casing tube to the head cap.

* * * * *